US005801724A

United States Patent [19]

Ju

[11] Patent Number: 5,801,724

[45] Date of Patent: Sep. 1, 1998

[54] CIRCUIT FOR PREVENTING INK CLOGGING IN PRINT NOZZLES OF A PRINT HEAD IN AN INK JET PRINTER

[75] Inventor: Young-Bok Ju, Sungnam, Rep. of Korea

[73] Assignee: SamSung Electronics Co., Ltd., Kyungki-do, Rep. of Korea

[21] Appl. No.: 728,695

[22] Filed: Oct. 10, 1996

[30] Foreign Application Priority Data

Oct. 18, 1995 [KR] Rep. of Korea ..... 35971/1995

[51] Int. Cl.[6] ..... B41J 2/165

[52] U.S. Cl. ..... 347/23

[58] Field of Search ..... 347/23, 29, 19, 347/17

[56] References Cited

U.S. PATENT DOCUMENTS

| | | | |
|---|---|---|---|
| 4,540,997 | 9/1985 | Biggs et al. | 347/23 |
| 4,692,777 | 9/1987 | Hasumi | 347/23 |
| 4,707,714 | 11/1987 | Rosenthal et al. | 347/29 |
| 5,117,244 | 5/1992 | Yu | 347/29 |
| 5,341,163 | 8/1994 | Hanabusa | 347/23 |
| 5,359,358 | 10/1994 | Shimamura | 347/9 |
| 5,389,961 | 2/1995 | Takagi | 347/29 |
| 5,406,317 | 4/1995 | Shimamura et al. | 347/23 |
| 5,448,270 | 9/1995 | Osborne | 347/29 |
| 5,448,271 | 9/1995 | Yamaguchi et al. | 347/30 |
| 5,572,242 | 11/1996 | Fujii et al. | 347/23 |

FOREIGN PATENT DOCUMENTS

| | | | |
|---|---|---|---|
| 6-126949 | 5/1994 | Japan | 347/23 |

*Primary Examiner*—S. Lee
*Attorney, Agent, or Firm*—Robert E. Bushnell, Esq.

[57] ABSTRACT

A circuit for controlling a printhead of an inkjet printer has a power supply unit for supplying different levels of first and second power voltages; a power control circuit which has a power switch and generates a power on signal or a power off signal in accordance with the on/off operation of the power switch; a first switching circuit which is switched on to form a transmission path for the first power voltage to generate a first switching power voltage if the power on signal is received, and is switched off to isolate the transmission path for the first power voltage if the power off signal is received; a second switching circuit for switching the second power voltage in accordance with the logic state of the first switching power voltage; a control unit which receives the first switching power voltage as an operating power to generate a switch on signal to the first switching circuit if the power on signal is received, and to generate a control signal for moving the printhead to a capping position and then output a switch off signal to the first switching circuit if the power off signal is received; and a driving unit which receives the first and second switching power voltages as an operating power and is driven to move the printhead to the capping position in response to the control signal output from the control unit.

19 Claims, 3 Drawing Sheets

CIRCUIT FOR PREVENTING INK CLOGGING IN PRINT NOZZLES OF A PRINT HEAD IN AN INK JET PRINTER

CROSS-REFERENCE TO RELATED APPLICATION

This application makes reference to, incorporates the same herein, and claims all benefits accruing under 35 U.S.C. §119 from an application for CIRCUIT AND METHOD FOR CONTROLLING A PRINT HEAD IN AN INK JET PRINTER earlier filed in the Korean Industrial Property Office on 18 Oct. 1995, and there duly assigned Ser. No. 35971/1995.

BACKGROUND OF THE INVENTION

1. Technical Field

The present invention relates to an ink jet printer, and more particularly to a circuit and method for controlling a print head in an ink jet printer to prevent ink clogs in the printing nozzles of such a print head.

2. Background Art

Generally, ink jet printers are available in either "continuous stream" or "drop-on-demand" type. In the continuous stream type of printer, ink is ejected under pressure continuously from one or more orifices in a printhead. The ink in the printhead is perturbated, for example, a piezoelectric device causing the streams of ink to breakup into droplets from the nozzles where charging electrodes are located. The charging electrodes induce charges on the droplets to eject either onto a recording medium during printing or into a gutter where the droplets are collected for recirculation. In the drop-on-demand type of printer, ink is contained in a plurality of channels in a printhead under a slightly negative pressure and electrical energy pulses are used to rapidly heat thermal transducers in the channels to form momentary ink vapor bubbles which causes the droplets of ink to be expelled from the orifices at the ends of the channels toward a recording medium.

When the ink jet printer is not in operation, however, ink not expelled in one or more orifices can dry and clog the orifice, causing failure or reduced ink flow through the orifice resulting in poor print quality. One prevalent technique in the art to prevent ink from drying in the orifices is to cap the inkjet nozzles using various configurations of a cap as disclosed, for example, in U.S. Pat. No. 4,707,714 for Covering Device For Protecting The Nozzle Area Of An Ink Jet Writing Head issued to Rosenthal et al., U.S. Pat. No. 5,117,244 for Nozzle Capping Device For An Ink Jet Printhead issued to Yu, and U.S. Pat. No. 5,488,270 for Ink-Jet Printhead Cap Having Suspended Lip issued to Osborne. Once the nozzles are capped, suction recovery device such as disclosed in U.S. Pat. No. 5,389,961 for Ink Jet Printer With Variable-Force Ink Declogging Apparatus issued to Takagi and U.S. Pat. No. 5,448,271 for Recovery Method For Ink Jet Recording Head issued to Yamaguchi et al., may be used to remove any ink clogs which have already formed in the nozzles. Other recovery devices such as an ink absorbing member disclosed in U.S. Pat. No. 5,406,317 for Ink Jet Recording With Coordinated Capping And Recovery Ejection Operations issued to Shimamura et al., are provided to absorb ink remaining in the nozzles as a result of ink ejection.

The nozzles of the printhead is usually capped after the power source is turned off or during a standby mode in which an operating power is cut off or when no data is provided from a host computer for a predetermined time period. Before the printhead is capped however, the position of a carriage supporting the printhead must be recognized so as to move the printhead into a capping position. A typical position recognition technique is disclosed, for example, in U.S. Pat. No. 5,359,358 for Recording Apparatus With Ink Jet Recording Head And Capping Device issued to Shimamura et al. During a standby mode after each printing operation, however, the operating power is cut off. If the printhead is not at a capping position between printing operations, ink contained in the nozzles of the printhead can still be desiccated. Once the ink contained in the nozzles of the printhead becomes dry, ink can not be ejected properly upon operation of a next print mode.

Therefore, in order to reduce the viscosity increase of ink between successive printing operations, the conventional art seeks to continuously apply power to a control unit for controlling overall operations of the ink jet printer and a driving unit for driving various motors and elements of the ink jet printer even after completion of a print mode. When power is continuously applied the printer, the control unit generates a control signal to the driving unit to move the printhead to the capping position. However, since the power is continuously applied to the control unit and driving unit even after the print mode, power consumption is undesirably increased.

SUMMARY OF THE INVENTION

Accordingly, it is therefore an object of the present invention to provide an improved power control apparatus for controlling power supply to a printhead of an inkjet printer to improve printer energy efficiency.

It is another object to provide a power control apparatus for efficiently regulating the power supply to a printhead of an inkjet printer to permit reliable capping of the printhead so as to prevent ink contained in the nozzles of the printhead from being dried.

These and other objects can be achieved by a power control apparatus for controlling a printhead of an ink jet printer including a power supply unit for supplying different levels of first and second power voltages; a power control circuit which has a power switch and generates a power on signal or a power off signal in accordance with the on/off operation of the power switch; a first switching circuit which is switched on to form a transmission path for the first power voltage to generate a first switching power voltage if the power on signal is received, and is switched off to isolate the transmission path for the first power voltage if the power off signal is received; a second switching circuit for switching the second power voltage in accordance with the logic state of the first switching power voltage; a control unit which receives the first switching power voltage as an operating power to generate a switch on signal to the first switching circuit if the power on signal is received, and to generate a control signal for moving the printhead to a capping position and then output a switch off signal to the first switching circuit if the power off signal is received; and a driving unit which receives the first and second switching power voltages as an operating power and is driven to move the printhead to the capping position in response to the control signal output from the control unit.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
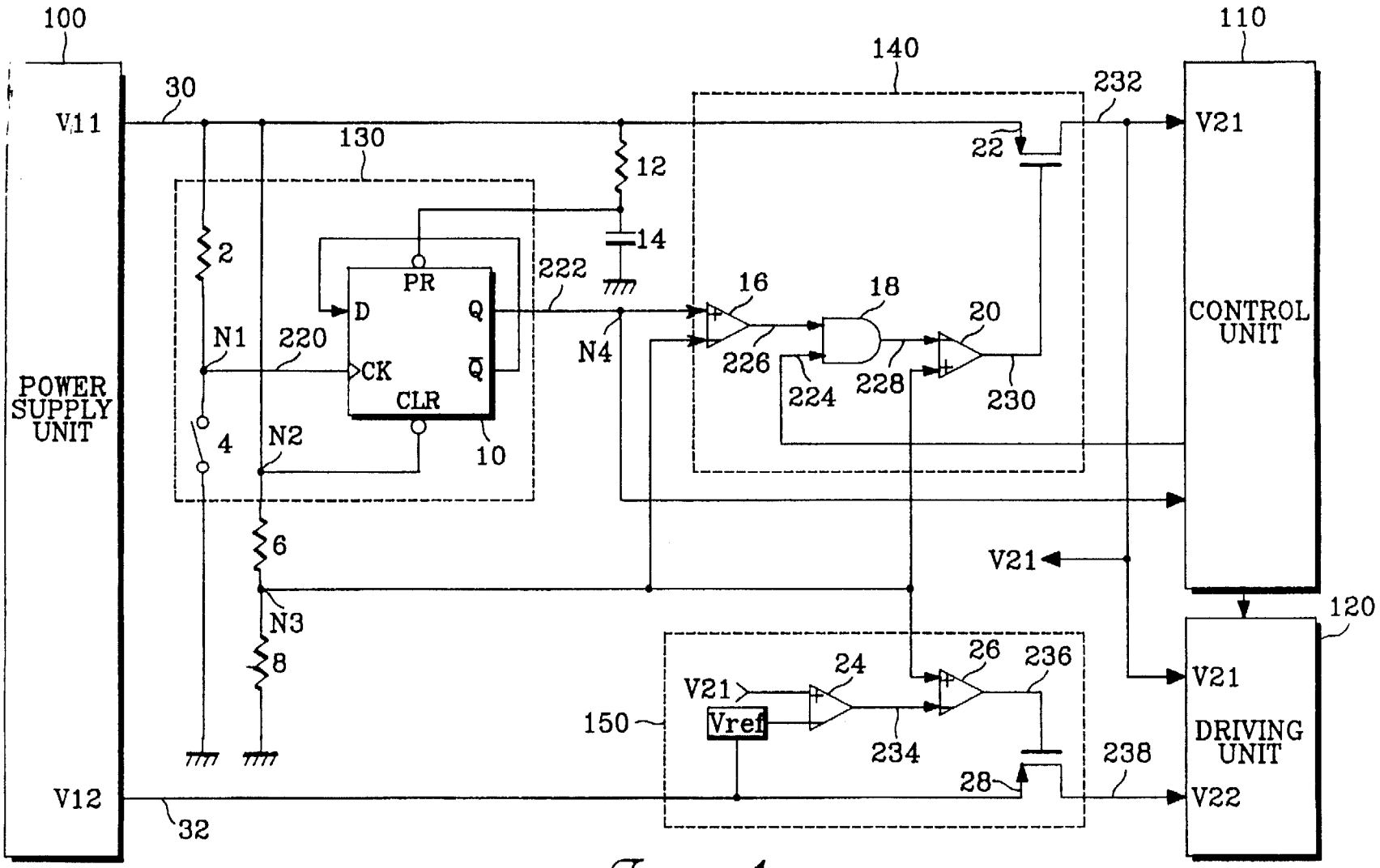
FIG. 1 illustrates a power control apparatus for controlling a printhead of an inkjet printer constructed according to the principles of the present invention.

Referring now to the drawings and particularly to FIG. 1, which illustrates a power control apparatus for controlling a printhead of an inkjet printer constructed according to the principles of the present invention. The power control apparatus includes a power supply unit 100 for providing first and second power voltages V11 and V12, a control unit 110 for controlling operations of the printer, a driving unit 120 for driving various motors to support movement of the printhead, a power control circuit 130 connected to the power supply unit 100 for controlling power supply to the control unit 110, a first switching circuit 140 connected between the power control circuit 130 and the control unit 110 for controlling selective transmission of the power supply to the control unit 110 to control movement of the printhead, and a second switching circuit 150 connected between the power control unit 130 and the driving unit 120 to drive the printhead to a capping position for capping under control of the control unit 110.

As shown in FIG. 1, the power supply unit 100 outputs different levels of first and second power voltages V11 and V12. The power control circuit 130 includes a power switch 4 for enabling a user to turn on or turn off the power supply to the printhead, and a D flip-flop 10 which is coupled to receive the first power voltage V11 to generate either a power on signal or a power off signal indicating whether power is supplied to the printhead. When the first power voltage V11 is generated as a pulse signal by an on/off operation of the power switch 4, the D flip-flop 10 outputs a power on signal or a power off signal in response to the pulse signal. The output of a power control circuit 130 including the power switch 4 and the D flip-flop 10 is applied to the first switching circuit 140 and to the control unit 110.

If the output of the power control circuit 130 is the power on signal, the control unit 110 generates a switch on signal which has the same voltage level as the power on signal to the first switching circuit 140. If the output of the power control circuit 130 is the power off signal, the control unit 110 senses the present position of the printhead and then moves the printhead to a capping position for capping. Then, the control unit 110 outputs a switch off signal which has the same voltage level as the power off signal to the first switching circuit 140.

The first switching circuit 140 includes a first comparator 16 coupled to compare the output of the power control circuit 130 with a reference voltage $V_{N3}$ which is obtained by voltage-dividing the first power voltage V11 by resistors 6 and 8. An AND gate 18 then logically combines the output of the first comparator 16 and the switch on signal or switch off signal output from the control unit 110. A second comparator 20 compares the output of the AND gate 18 with the reference voltage $V_{N3}$. An NPN type field effect transistor 22 ("NPN type FET") is switched in accordance with the output of the second comparator 20. If the NPN type FET is switched on, the first power voltage V11 is applied as a first switching power V21 to the control unit 110, the driving unit 120 and the second switching circuit 150.

The second switching circuit 150 includes a third comparator 24 coupled to compare the first switching power V21 with a reference voltage Vref A fourth comparator 26 compares the output of the third comparator 24 with the reference voltage $V_{N3}$. In this case, the reference voltage $V_{N3}$ is set to be lower than the levels of the pulse signals 222, 228 and 234. A PNP type field effect transistor 28 ("PNP type FET") is switched in accordance with the output of the fourth comparator 26. If the PNP type FET 28 is switched on, the second power V12 is applied as a second switching power V22 to the driving unit 120. Therefore, the control unit 110 receives the first switching power V21, thereby controlling the overall operations of the inkjet printer. If the power off signal is applied to the control unit 110, the control unit 110 moves the printhead to the capping position and then generates the switch off signal to cut off the power.

In the meanwhile, the driving unit 120 receives the first and second switching power voltages V21 and V22 as operating power to drive various motors and elements of the inkjet printer under the control of the control unit 110. If a printhead control signal which is generated in response to the power off signal is applied to the driving unit 120, the driving unit 120 moves the printhead to the capping position and then cutting off the operating power, i.e. the first and second switching power voltages V21 and V22.

Figures 2A, 2B, 2C, 2D, 2E, 2F, 2G, 2H, 2I, 2J:
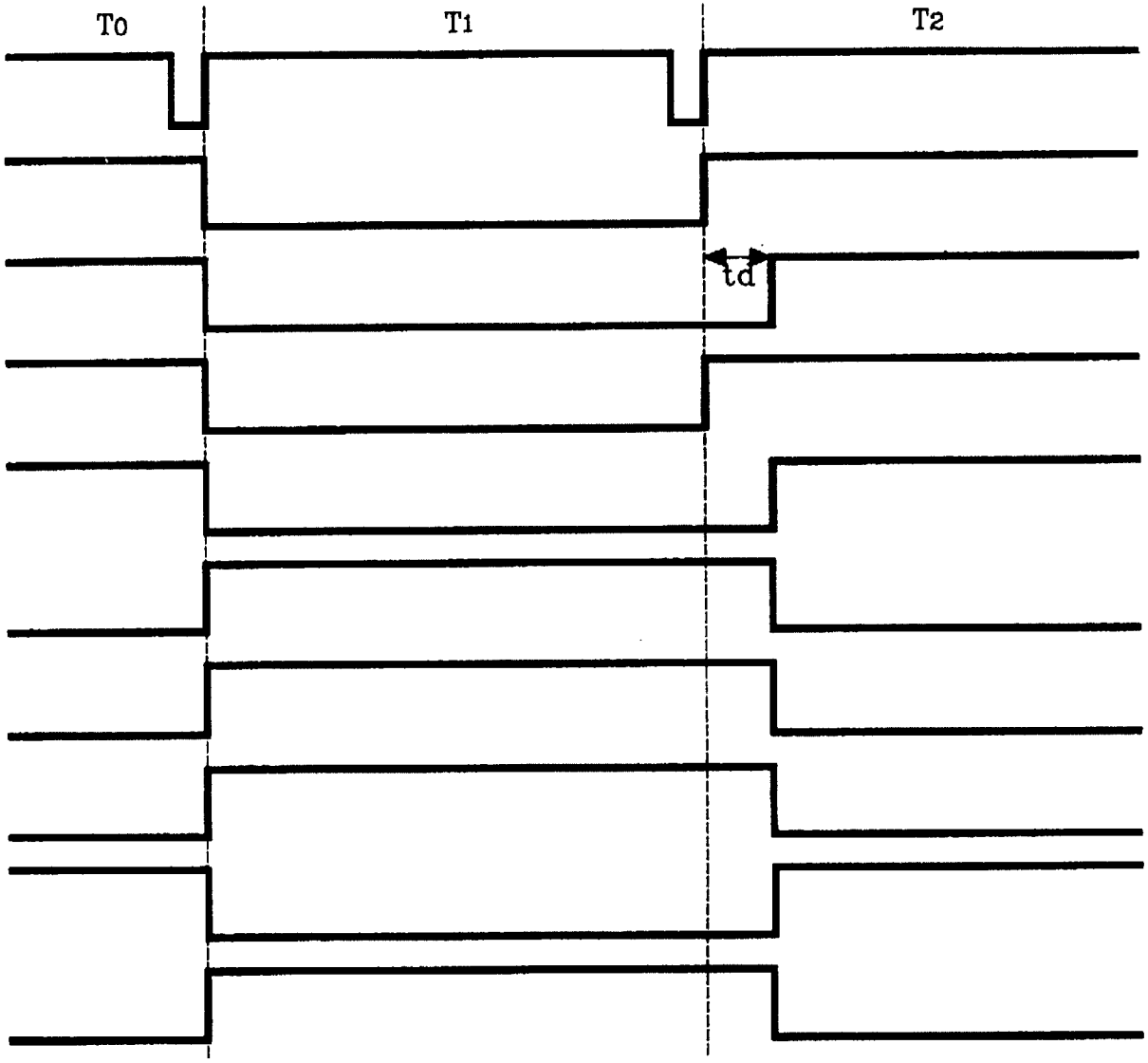
FIGS. 2A to 2J are timing diagrams illustrating operational characteristics of respective elements of the power control apparatus as shown in FIG. 1.

Turning now to FIGS. 2A to 2J which are timing diagrams illustrating operational characteristics of respective circuit elements of the power control apparatus as shown in FIG. 1. The power supply unit 100 applies the first power voltage V11 to a lead line 30. The first power voltage V11 is continuously applied to a first node N1. During the time period T0, node N1 applies a pulse signal 220 of a logic "high" level to the clock terminal CK of the D flip-flop 10 as shown in FIG. 2A. The output terminal $\overline{Q}$ of the D flip-flop 10 is connected to an input terminal D thereof. The first power voltage V11 is continuously applied to a clear terminal CLR via a second node N2. An integral signal of the first power voltage V11 is applied to a preset terminal PR of the D flip-flop 10 by a resistor 12 and a capacitor 14. The output terminal Q of the D flip-flop 10 outputs a pulse signal 222 of logic "high" level as shown in FIG. 2B.

Referring to the time period T1 of FIGS. 2A to 2J, when the power switch 4 is switched on, node N1 supplies the pulse signal 220 of logic "high" level as shown in FIG. 2A. The pulse signal 220 from the node N1 serves as a clock pulse of the clock terminal CK in the D flip-flop 10. Thus, if the clock pulse is at the rising edge, the pulse signal 222 output from the output terminal Q transits to the logic "low" level as shown in FIG. 2B. The pulse signal 222 output from the D flip-flop 10 is applied to the first comparator 16 and to the control unit 110. The control unit 110 outputs the switch on signal, i.e. the pulse signal 224 which has the same level as the pulse signal 222 as shown in FIG. 2C. The first comparator 16 has a non-inverted terminal coupled to receive the pulse signal 222 and an inverted terminal coupled to receive the reference voltage $V_{N3}$ to produce a pulse signal 226 of a logic "low" level as shown in FIG. 2D. The AND gate 18 ANDs the pulse signal 226 output from the first comparator 16 and the pulse signal 224 output from the control unit 110 to produce a pulse signal 228 of a logic "low" level as shown in FIG. 2E. The pulse signal 228 is applied to the inverted terminal of the second comparator 20 and the reference voltage $V_{N3}$ to the non-inverted terminal thereof. The second comparator 20 then inverts the pulse signal 228 to produce a pulse signal 230 of a logic "high" level as shown in FIG. 2F. The pulse signal 230 is applied to the gate of the NPN type FET 22, thus turning on the NPN type FET 22. The first power voltage V11 is connected to the source of the NPN type FET 22 via the lead line 30. Therefore, the switched first power voltage V11, i.e. the first switching power voltage V21 is applied to the control unit 110. In addition, the first switching power voltage V21 is applied to the non-inverted terminal of the third comparator 24 and the reference voltage Vref is applied to the inverted terminal thereof. Then, the third comparator 24 is not inverted to produce a pulse signal 234 of a logic "high" level as shown in FIG. 2H. The pulse signal 234 is applied to the inverted terminal of the fourth comparator 26 and the reference voltage $V_{N3}$ to the non-inverted terminal thereof. Then, the fourth comparator 26 inverts the pulse signal 234 to produce a pulse signal 236 of a logic "low" level as shown in FIG. 2I. The pulse signal 236 is applied to the gate of the PNP type FET 28, thus turning on the PNP type FET 28. Since the second power voltage V12 is connected to the source of the PNP type FET 28 via the lead line 32, the second power voltage V12 is applied as the second switching power voltage V22 to the driving unit 120. Accordingly, the first and second switching power voltages V21 and V22 are applied to the driving unit 120 by the operations as described.

Referring to the time period T2, when the power switch 4 is switched off, node N1 supplies the pulse signal 220 as shown in FIG. 2A. The pulse signal 220 serves as the clock pulse of the D flip-flop 10. At the rising edge of the clock pulse, the pulse signal 222 output from the output terminal Q transits to the logic "high" level as shown in FIG. 2B. The pulse signal 222 is applied both to the control unit 110 and to the first comparator 16. In response to the pulse signal 222, the control unit 110 senses the position of the printhead and then generates the printhead control signal for moving the printhead to the capping position. In response to the printhead control signal, the driving unit 120 drives a driving motor of the printhead to move the printhead to the capping position. Thereafter, the control unit 110 outputs the switch off signal, i.e. the pulse signal 224 to the AND gate 18. At this time, the switch off signal is output to the AND gate 18 after being delayed by the time period td required in moving the printhead to the capping position. The pulse signal 222 output from the D flip-flop 10 is applied to the non-inverted terminal of the first comparator 16 and the reference voltage $V_{N3}$ to the inverted terminal thereof. Then, the first comparator 16 is not inverted to produce the pulse signal 226 of logic "high" level. The AND gate 18 ANDs the pulse signal 226 and the switch off signal 224 and outputs the pulse signal 228 of logic "high" level. The pulse signal 228 is applied to the inverted terminal of the second comparator 22 and the reference voltage $V_{N3}$ to the non-inverted terminal thereof. Then, the second comparator 20 is inverted to produce the pulse signal 230 of logic "low" level to the gate of the NPN type FET 22. Thereafter, the NPN type FET 22 is turned off to isolate the transmission path between the first power voltage V11 and the control unit 110. The pulse signal 212 then switches to the logic "low" level. The first switching power voltage V21 is applied to the non-inverted terminal of the third comparator 24 and the reference Vref to the inverted terminal thereof. Then, the third comparator 24 is not inverted to produce the pulse signal 234 of a logic "low" level as shown in FIG. 2H. The pulse signal 234 is applied to the inverted terminal of the fourth comparator 26 and the reference voltage $V_{N3}$ to the non-inverted terminal thereof. Then, the fourth comparator 26 is inverted to produce the pulse signal 236 of a logic "high" level to the gate of the PNP type FET 28. The PNP type FET 28 is then turned off and thus the second switching power voltage V22 is not applied to the driving unit 120. Therefore, the first and second switching power voltages V21 and V22 are not applied to the driving unit 120 during the time period T2.

Figure 3:
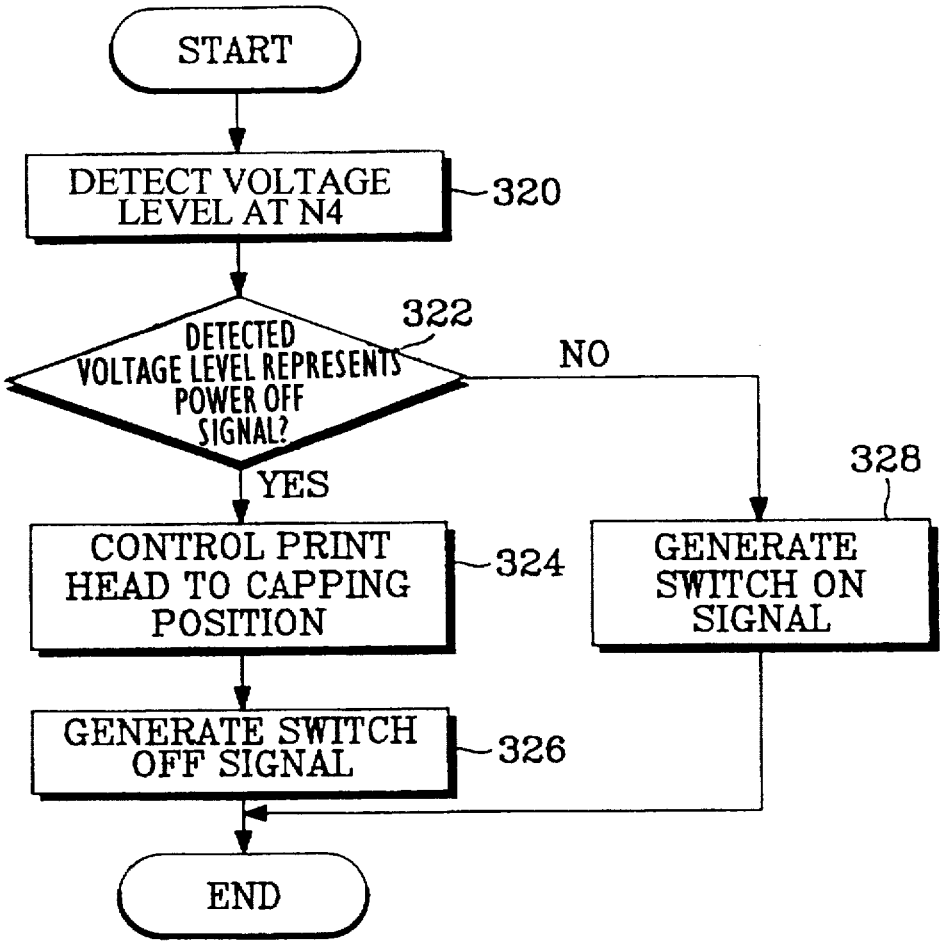
FIG. 3 is a flow chart illustrating a process of controlling the printhead of the inkjet printer according to the principles of the present invention.

FIG. 3 illustrates a process of controlling the printhead of the ink jet printer using the power control apparatus constructed according to the principles of the present invention. In a print mode, the control unit 110 detects the voltage level of the signal at node N4 at step 320. The control unit 110 then determines whether or not the detected voltage level represents a power off signal at step 322. When the detected voltage level represents the power off signal, the control unit 110 moves the printhead to the capping position at step 324. That is, after completion of the print mode, the control unit 110 senses the present position of the printhead, counts the distance from the present position to the capping position of the printhead and then moves the printhead to the capping position by reversely driving the driving motor of the printhead according to the counted distance. After moving the printhead to the capping position, the control unit 110 generates a switch off signal of a logic "high" level to the first switching circuit 140 at step 326. Thereby, the second comparator outputs the logic "low" level to the gate of the NPN type FET 22 and thus the NPN type FET 22 is turned off, cutting off the supply of the first power voltage V11. Thereafter, the PNP type FET 28 is also turned off, cutting off the supply of the second power voltage V12. Accordingly, even after completion of the print mode, the power is supplied for a predetermined time period. Then, the control unit 110 controls the driving unit 120 to move the printhead to the capping position. After completion of the moving to the capping position, the power is cut off. In the meanwhile, if the detected voltage level represents a power on signal at step 322, the control unit 110 outputs, at step 328, a switch on signal of a logic "low" level so as to maintain the print mode.

As described above, upon operation of the power switch 4, the power on signal is generated and thus the control unit 110 and the driving unit 120 are supplied with the power. When the power switch is turned off, the power off signal is generated and thus the control unit 110 moves the printhead to the capping position and thereafter the power which is to be supplied to the control unit 110 and the driving unit 120 is cut off. Accordingly, with the on/off operation of the power switch 4, the present invention can reduce the power consumption, while printing properly even at the beginning of the printing operation.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An apparatus for controlling a printhead of a printer, comprising:

a power supply unit supplying first and second power voltages;

a power control circuit coupled to receive said first power voltage, generating one of a power on signal and a power off signal in response to operation of said printer;

a first switching circuit operable to regulate transmission of said first power voltage as a first switching power voltage in response to receipt of said one of said power on signal and said power off signal;

a second switching circuit operable to regulate transmission of said second power voltage as a second switching power voltage in response to said first switching power voltage;

a control unit having a power terminal coupled to receive said first switching power voltage serving as an operating power and a control terminal coupled to receive said one of said power on signal and said power off signal, generating a switch-on signal to said first switching circuit enabling said first switching circuit to receive said first switching power voltage, and alternatively, generating a control signal to move said printhead to a capping position capping and then generating a switch off signal to said first switching circuit; and a driving unit coupled to receive said first and second switching power voltages as said operating power and driven to move said printhead to said capping position for capping in response to said control signal.

2. The apparatus of claim 1, further comprised of said power control circuit comprising:

a power switch operable in one of an "on" mode and an "off" mode for enabling an operator to supply power to the printhead; and a D flip-flop having a clock terminal coupled to receive said first power voltage via a first resistor, a preset terminal coupled to receive said first power voltage via a second resistor, a clear terminal coupled to receive said first power voltage, an output terminal generating one of said power on signal and said power off signal, and a complementary output terminal connected to a data terminal.

3. The apparatus of claim 1, further comprised of said first switching circuit comprising:

a first comparator comparing a voltage level of a first reference voltage with a voltage level of one of said power on signal and said power off signal to produce a first compared signal;

a AND gate logically combining said first compared signal and one of said switch on signal and said switch off signal generated from said control unit to produce a logic signal;

a second comparator comparing the voltage level of said first reference voltage with a voltage level of said logic signal to produce a second compared signal; and a switch operable to enable transmission of said first power voltage as said first switching power voltage in response to said second compared signal.

4. The apparatus of claim 3, further comprised of said switch representing a NPN type of field-effect transistor having a first electrode of a principle electrically conducting channel coupled to receive said first power voltage, a second electrode of said principle electrically conducting channel coupled to said power terminal of said control unit and a control electrode coupled to receive said second compared signal.

5. The apparatus of claim 1, further comprised of said second switching circuit comprising:

means generating first and second reference voltages;

a first comparator comparing a voltage level of said first switching power voltage with a voltage level of said first reference voltage to produce a first compared signal;

a second comparator comparing the first compared signal with said second reference voltage to produce a second compared signal; and a switch operable to enable transmission of said second power voltage as said second switching power voltage in response to said second compared signal.

6. The apparatus of claim 5, further comprised of said switch representing a PNP type of field-effect transistor having a first electrode of a principle electrically conducting channel coupled to receive said second power voltage, a second electrode of said principle electrically conducting channel coupled to a power terminal of said driving unit and a control electrode coupled to receive said second compared signal.

7. An apparatus for controlling a printhead of a printer, comprising:

a power supply source for supplying first and second power voltages;

controller means for generating a control signal to move the printhead to a capping position after each printing operation and cutting off the supply of said first and second power voltages after the printhead is positioned at said capping position;

driver means for moving the printhead to said capping position in response to said control signal; and power regulator means for regulating the supply of said first and second power voltages to said controller means and said driver means in response to operation of a power switch, said power switch being operable in one of an "on" mode and an "off" mode for enabling an operator to supply said first and second power voltages to said controller means and said driver means.

8. The apparatus of claim 7, further comprised of said power regulator means comprising:

a power control circuit coupled to receive said first power voltage, for generating one of a power on signal and a power off signal in response to operation of said power switch;

a first switching circuit operable to regulate transmission of said first power voltage as a first switching power voltage in response to reception of said one of said power on signal and said power off signal; and a second switching circuit operable to regulate transmission of said second power voltage as a second switching power voltage in response to a logic state of said first switching power voltage.

9. The apparatus of claim 8, further comprised of said power control circuit comprising a D flip-flop having a clock terminal coupled to receive said first power voltage via a first resistor, a preset terminal coupled to receive said first power voltage via a second resistor, a clear terminal coupled to receive said first power voltage, an output terminal generating one of said power on signal and said power off signal, and a complementary output terminal connected to a data terminal.

10. The apparatus of claim 8, further comprised of said first switching circuit comprising:

a first comparator comparing a voltage level of a first reference voltage with a voltage level of one of said power on signal and said power off signal to produce a first compared signal;

a AND gate logically combining said first compared signal and one of a switch on signal and a switch off signal generated from said controller means to produce a logic signal;

a second comparator comparing the voltage level of said first reference voltage with a voltage level of said logic signal to produce a second compared signal; and a switch operable to enable transmission of said first power voltage as said first switching power voltage in response to said second compared signal.

11. The apparatus of claim 10, further comprised of said switch representing a NPN type of field-effect transistor having a first electrode of a principal electrically conducting channel coupled to receive said first power voltage, a second electrode of said principal electrically conducting channel coupled to said controller means and a control electrode coupled to receive said second compared signal.

12. The apparatus of claim 8, further comprised of said second switching circuit comprising:

means generating first and second reference voltages;

a first comparator for comparing a voltage level of said first switching power voltage with said first reference voltage to produce a first compared signal;

a second comparator comparing said first compared signal with said second reference voltage to produce a second compared signal; and a switch operable to enable transmission of said second power voltage as said second switching power voltage in response to said second compared signal.

13. The apparatus of claim 12, further comprised of said switch representing a PNP type of field-effect transistor having a first electrode of a principal electrically conducting channel coupled to receive said second power voltage, a second electrode of said principal electrically conducting channel coupled to said driver means and a control electrode coupled to receive said second compared signal.

14. A process of controlling a printhead of an ink jet printer, comprising the steps of:

determining whether a power switch of said ink jet printer is turned "on" or turned "off", said ink jet printer comprising said printhead with nozzles, a power supply source, a driver for moving said printhead to a capping position for capping to avoid ink contained in the nozzles of said printhead from drying, and a controller for controlling movement of said printhead to said capping position after each printing operation;

when said power switch is turned "on", providing power supply from said power supply source to both said controller and said driver to perform printing operations;

alternatively when said power switch is turned "off", generating a power off signal to said controller to determine a current position of said printhead with respect to said capping position, and move said printhead to said capping position for capping to avoid ink contained in the nozzles of said printhead from drying; and after moving said printhead to said capping position said controller outputting a signal for cutting off power supply from said power supply source to avoid ink contained in the nozzles of said printhead from drying.

15. An apparatus for controlling a printhead of a printer, comprising:

a power supply unit supplying first and second power voltages;

a first switch circuit operable to regulate transmission of said first power voltage as a first switch power voltage in response to operation of a power switch;

a second switch circuit operable to regulate transmission of said second power voltage as a second switch power voltage in response to receipt of said first switch power voltage;

a control unit connected to said first and said second switch circuit, for generating a control signal to move said printhead to a capping position for capping to prevent ink contained in nozzles of said printhead from drying; and a driving unit connected to said first and said second switch circuit, for moving said printhead to said capping position for capping to prevent ink contained in the nozzles of said printhead from drying in response to said control signal.

16. The apparatus of claim 15, further comprised of said first switch circuit comprising:

a first comparator comparing a first reference voltage with one of a power on signal and a power off signal generated from said power switch to produce a first compared signal;

a AND gate logically combining said first compared signal and a switch on/off signal generated from said control unit to produce a logic signal;

a second comparator comparing said first reference voltage with said logic signal to produce a second compared signal; and a transistor operable to enable transmission of said first power voltage as said first switch power voltage in response to said second compared signal.

17. The apparatus of claim 16, further comprised of said transistor corresponding to a NPN type of field-effect transistor having a first electrode of a principal electrically conducting channel coupled to receive said first power voltage, a second electrode of said principal electrically conducting channel coupled to said control unit and a control electrode coupled to receive said second compared signal.

18. The apparatus of claim 15, further comprised of said second switch circuit comprising:

a first comparator comparing said first switch power voltage with a first reference voltage to produce a first compared signal;

a second comparator comparing said first compared signal with a second reference voltage to produce a second compared signal; and a transistor operable to enable transmission of said second power voltage as said second switch power voltage in response to said second compared signal.

19. The apparatus of claim 18, further comprised of said switch corresponding to a PNP type of field-effect transistor having a first electrode of a principal electrically conducting channel coupled to receive said second power voltage, a second electrode of said principal electrically conducting channel coupled to said driving unit and a control electrode coupled to receive said second compared signal.

* * * * *